US011877652B2

(12) United States Patent
Foley et al.

(10) Patent No.: US 11,877,652 B2
(45) Date of Patent: Jan. 23, 2024

(54) ADJUSTABLE TABLE FOR USE IN WATER

(71) Applicant: Water Party, Inc., Lake Forest, IL (US)

(72) Inventors: Barbara Foley, Lake Forest, IL (US); Stephen Foley, III, Lake Forest, IL (US); Ryan Foley, Lake Forest, IL (US)

(73) Assignee: Water Party, Inc., Lake Forest, IL (US)

( * ) Notice: Subject to any disclaimer, the term of this patent is extended or adjusted under 35 U.S.C. 154(b) by 0 days.

(21) Appl. No.: 17/900,443

(22) Filed: Aug. 31, 2022

(65) Prior Publication Data

US 2023/0064396 A1 Mar. 2, 2023

Related U.S. Application Data

(60) Provisional application No. 63/238,862, filed on Aug. 31, 2021.

(51) Int. Cl.
*A47B 37/04* (2006.01)

(52) U.S. Cl.
CPC ..... *A47B 37/04* (2013.01)

(58) Field of Classification Search
CPC ..... A47B 37/04; A47B 3/06; A47B 2013/024; A47B 13/16; A47B 13/023; A47B 9/20; E04H 12/2246; E04H 12/2269; E04H 12/2238; A45B 23/00; A45B 2023/0012; A45B 2200/1063

(Continued)

(56) References Cited

U.S. PATENT DOCUMENTS 3,665,867 A * 5/1972 Carlson ..... A47B 31/02 211/74
3,794,279 A * 2/1974 Kramer ..... E04H 12/2246 248/529

(Continued)

FOREIGN PATENT DOCUMENTS

CN 102217892 A 10/2011
CN 212766644 U 3/2021

(Continued)

OTHER PUBLICATIONS

Farrer, "DIY Umbrella Stand with Side Table" (2021), https://housefulofhandmade.com/make-your-own-umbrella-stand-side-table, retrieved Aug. 17, 2021.

(Continued)

*Primary Examiner* — Janet M Wilkens
(74) *Attorney, Agent, or Firm* — McDonnell Boehnen Hulbert & Berghoff LLP

(57) ABSTRACT

The present disclosure relates to an adjustable table including (i) a base, (ii) a first elongated rod coupled to the base, wherein the first elongated rod includes one or more first through holes, (iii) a second elongated rod configured to translate with respect to the first elongated rod, wherein the second elongated rod includes one or more second through holes, (iv) a table top coupled to the second elongated rod, and (v) a coupling mechanism configured to be positioned between one of the one or more first through holes and one of the one or more second through holes to thereby set a distance between the table top and the base.

7 Claims, 2 Drawing Sheets

(58) Field of Classification Search
USPC ..... 108/50.12, 147.21; 135/98, 96, 16, 20.1, 135/20.3; 248/910, 160
See application file for complete search history.

(56) References Cited

U.S. PATENT DOCUMENTS

| | | | | |
|---|---|---|---|---|
| 4,145,044 | A * | 3/1979 | Wilson | A63B 63/083 403/379.5 |
| 4,582,287 | A | 4/1986 | DeLeary | |
| 5,463,535 | A | 10/1995 | Vest | |
| 5,517,702 | A * | 5/1996 | Fraher | E04H 4/108 248/161 |
| 7,520,485 | B1 | 4/2009 | Giannetto | |
| 8,464,646 | B1 * | 6/2013 | Schiller | A47B 37/04 135/16 |
| 8,789,549 | B1 * | 7/2014 | Barnes | E04H 12/2246 135/114 |
| 10,149,574 | B1 | 12/2018 | Harder | |
| 11,408,192 | B2 * | 8/2022 | Schwiebert | A45B 23/00 |
| 2006/0272555 | A1 | 12/2006 | Carter | |
| 2008/0011914 | A1 * | 1/2008 | McCombs | A47G 23/0241 248/146 |
| 2008/0203263 | A1 * | 8/2008 | Carnevali | F16M 13/022 29/527.1 |
| 2010/0163086 | A1 * | 7/2010 | Chavez | A47B 37/04 135/16 |
| 2016/0106187 | A1 * | 4/2016 | Sloan | A45B 23/00 135/16 |
| 2016/0242537 | A1 * | 8/2016 | Hernandez | A47B 9/08 |
| 2019/0078345 | A1 | 3/2019 | Harder | |
| 2021/0085075 | A1 | 3/2021 | Nolin | |
| 2022/0268049 | A1 * | 8/2022 | Frerich | A45B 23/00 |

FOREIGN PATENT DOCUMENTS

| | | | |
|---|---|---|---|
| EP | 3135149 | * | 3/2017 |
| KR | 20120076837 | * | 7/2012 |

OTHER PUBLICATIONS

"The Ultimate Patio Umbrella Buyers Guide" (2020), https://www.patioproductions.com/blog/patio-furniture/patio-umbrella-buyers guide, retrieved Aug. 17, 2021.
"FIX-O-SELF Mutli-Purpose MS Pipe Folding Table with Umbrella top", https://amazon.in/FIX-SELF-Multi-Purpose-Folding-Umbrella/dp/B08PTZH1GJ, retrieved Aug. 17, 2021.
"Costzon Kids 3 in 1 Convertible Picnic Table Set, Sand & Water Table with Removable & Height Adjustable Umbrella, Children Outdoor Indoor Toy Playset w/2 Play Boxes, Wood Activity Play Table", https://www.desertcart.on/products/205459207-costzon-kids-3-in-1-convertible-picnic-table-set-sand-water-table with-removable height-adjustable-umb . . . , retrieved Aug. 17, 2021.
"Fruiteam Umbrella Base Heavy Duty Stand Pole Holder WaterFilled 50LB Outdoor Patio Umbrella Base 1.5-inch Steel . . . ", https://www.amazon.in/Fruiteam-Umbrella-Thickened-Straight-Pole-Umbrellas/dp/B08B5CDMJ5, retrieved Aug. 17, 2021.

* cited by examiner

ADJUSTABLE TABLE FOR USE IN WATER

RELATED APPLICATION

This application claims priority to U.S. Provisional Application No. 63/238,862 entitled "Adjustable Table for Use in Water," filed on Aug. 31, 2021, the contents of which are hereby incorporated by reference in its entirety.

TECHNICAL FIELD

The present disclosure relates to an adjustable table, particularly an adjustable table for use in water.

BACKGROUND

Unless otherwise indicated herein, the materials described in this section are not admitted to be prior art to the claims in this application.

The use of outdoor furniture is well known. Outdoor tables commonly include an opening in the center of the table, which allows for insertion of an umbrella. The umbrella functions to shade the table and chairs around the table. While such designs are acceptable for use on land, many people enjoy wading in shallow water (either in natural bodies of water or pools). While in the water, it may be desirable to have a table and/or shade under an umbrella. However, the classic designs for outdoor furniture do not work well for use in water. As such, it is necessary to provide a table with an adjustable height for use in the water.

SUMMARY

In view of the foregoing, the present disclosure provides an adjustable table for use in water. The adjustable table includes (i) a base, (ii) a first elongated rod coupled to the base, wherein the first elongated rod includes one or more first through holes, (iii) a second elongated rod configured to translate with respect to the first elongated rod, wherein the second elongated rod includes one or more second through holes, (iv) a table top coupled to the second elongated rod, and (v) a coupling mechanism configured to be positioned between one of the one or more first through holes and one of the one or more second through holes to thereby set a distance between the table top and the base.

These as well as other aspects, advantages, and alternatives, will become apparent to those of ordinary skill in the art by reading the following detailed description, with reference where appropriate to the accompanying drawings.

DETAILED DESCRIPTION

Figure 1:
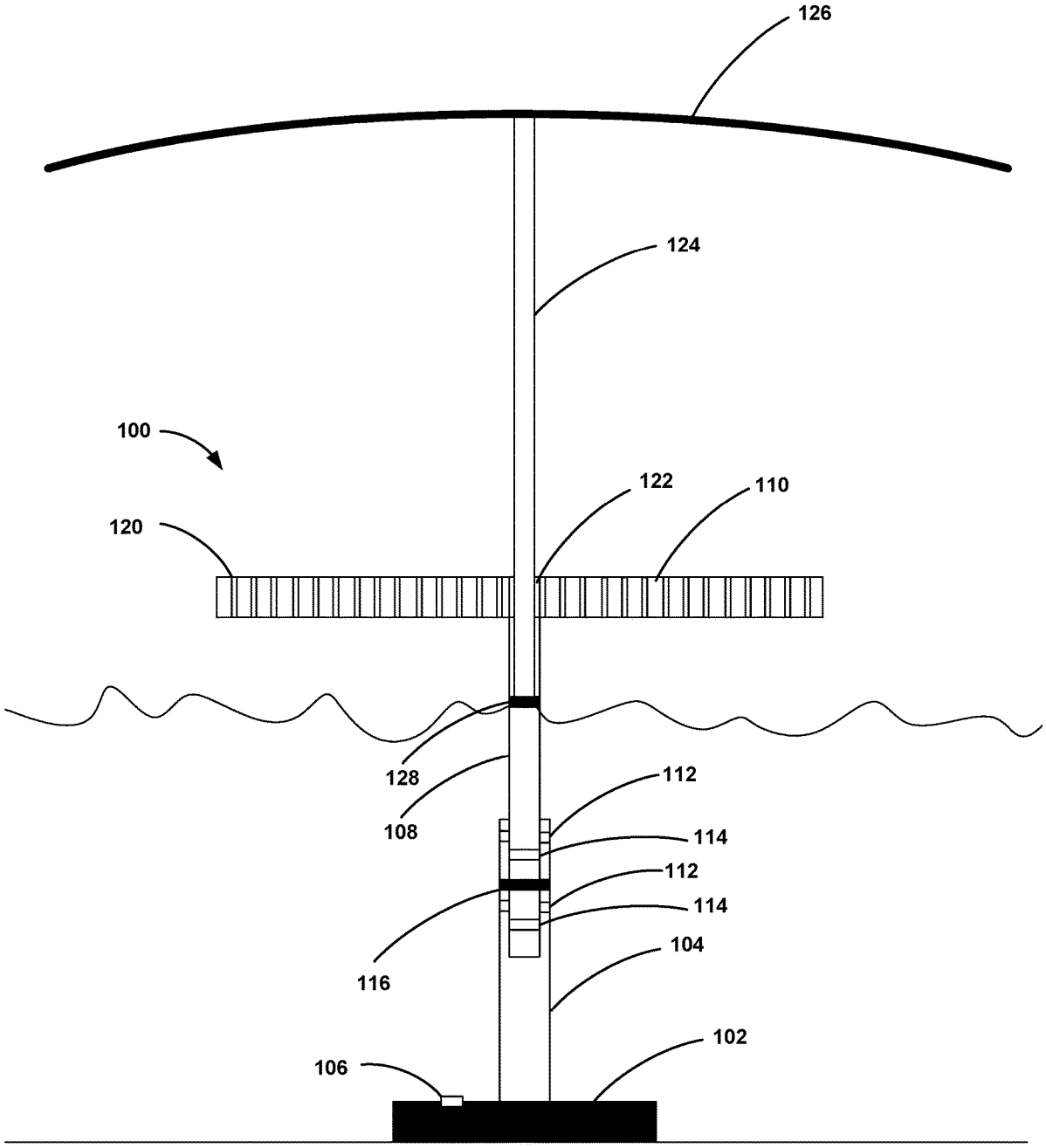
FIG. 1 illustrates a side cross-sectional view of an adjustable table, according to an exemplary embodiment.

Example methods and systems are described herein. It should be understood that the words "example," "exemplary," and "illustrative" are used herein to mean "serving as an example, instance, or illustration." Any example or feature described herein as being an "example," being "exemplary," or being "illustrative" is not necessarily to be construed as preferred or advantageous over other examples or features. The examples described herein are not meant to be limiting. It will be readily understood that the aspects of the present disclosure, as generally described herein, and illustrated in the figures, can be arranged, substituted, combined, separated, and designed in a wide variety of different configurations, all of which are explicitly contemplated herein.

Furthermore, the particular arrangements shown in the Figures should not be viewed as limiting. It should be understood that other examples may include more or less of each element shown in a given Figure. Further, some of the illustrated elements may be combined or omitted. Yet further, an example may include elements that are not illustrated in the Figures.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

As used herein, "coupled" means associated directly as well as indirectly. For example, a member A may be directly associated with a member B, or may be indirectly associated therewith, e.g., via another member C. It will be understood that not all relationships among the various disclosed elements are necessarily represented.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one embodiment" or "one example" means that one or more feature, structure, or characteristic described in connection with the example is included in at least one implementation. The phrases "one embodiment" or "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The limitations of the following claims are not written in means-plus-function format and are not intended to be interpreted based on 35 U.S.C. § 112(f), unless and until such claim limitations expressly use the phrase "means for" followed by a statement of function void of further structure.

By the term "about," "approximately," or "substantially" with reference to amounts or measurement values described herein, it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. For example, in one embodiment, the term "about" can refer to ±5% of a given value.

Illustrative, non-exhaustive examples, which may or may not be claimed, of the subject matter according the present disclosure are provided below.

With reference to the Figures, FIG. 1 the adjustable table 100 includes a base 102 coupled to a first elongated rod 104. In one example, the base 102 is removably coupled to the first elongated rod 104 to enable easier transport of the adjustable table 100. For example, the first elongated rod 104 may included a threaded end, and the base 102 may include a complementary threaded hole into which the threaded end of the first elongated rod 104 can be positioned. In another example, the first elongated rod 104 may be configured to be press fit within a hole in the base 102. Other examples of removable coupling between the first elongated rod 104 and the base 102 are possible as well.

In one example, the base 102 may be capable of being filled with a material (e.g., water or sand) to make the base weighted. For example, the base 102 may include a removable cap 106 that provides access to an interior region of the base 102. As such, the base 102 may be easy to transport in a lightweight configuration, and then may be weighted just prior to use. In one example, the base 102 comprises a non-rigid material such that the base 102 has a first shape when no material is positioned therein and the base 102 has a second shape when material is positioned therein. In such an example, the base 102 may essentially comprise a bag that can be filled with sand, rocks, or water as non-limiting examples once the adjustable table 100 is at a desired location just prior to use. In another example, the base 102 comprises a rigid material that can be filled with sand, rocks, or water as non-limiting examples once the adjustable table 100 is at a desired location just prior to use.

The adjustable table 100 also includes a second elongated rod 108 that is configured to translate with respect to the first elongated rod 104. In one example, as shown in FIG. 1, the first elongated rod 104 has a first inner diameter, and the second elongated rod 108 has a second outer diameter that is less than the first inner diameter such that the second elongated rod 108 is configured to slide within the first elongated rod 104. In another example, the first elongated rod 104 has a first inner diameter, and the second elongated rod 108 has a second outer diameter that is greater than the first inner diameter such that the first elongated rod 104 is configured to slide within the second elongated rod 108. Importantly, in each case the second elongated rod 108 is able to translate with respect to the first elongated rod 104.

As shown in FIG. 1, the adjustable table 100 also includes a table top 110 coupled to the second elongated rod 108. In one example, the table top 110 is removably coupled to the second elongated rod 108 to enable easier transport of the adjustable table 100. For example, the second elongated rod 108 may included a threaded end, and the table top 110 may include a complementary threaded hole into which the threaded end of the second elongated rod 108 can be positioned. In another example, the second elongated rod 108 may be configured to be press fit within a hole in the table top 110. Other examples of removable coupling between the second elongated rod 108 and the table top 110 are possible as well.

Figure 2:
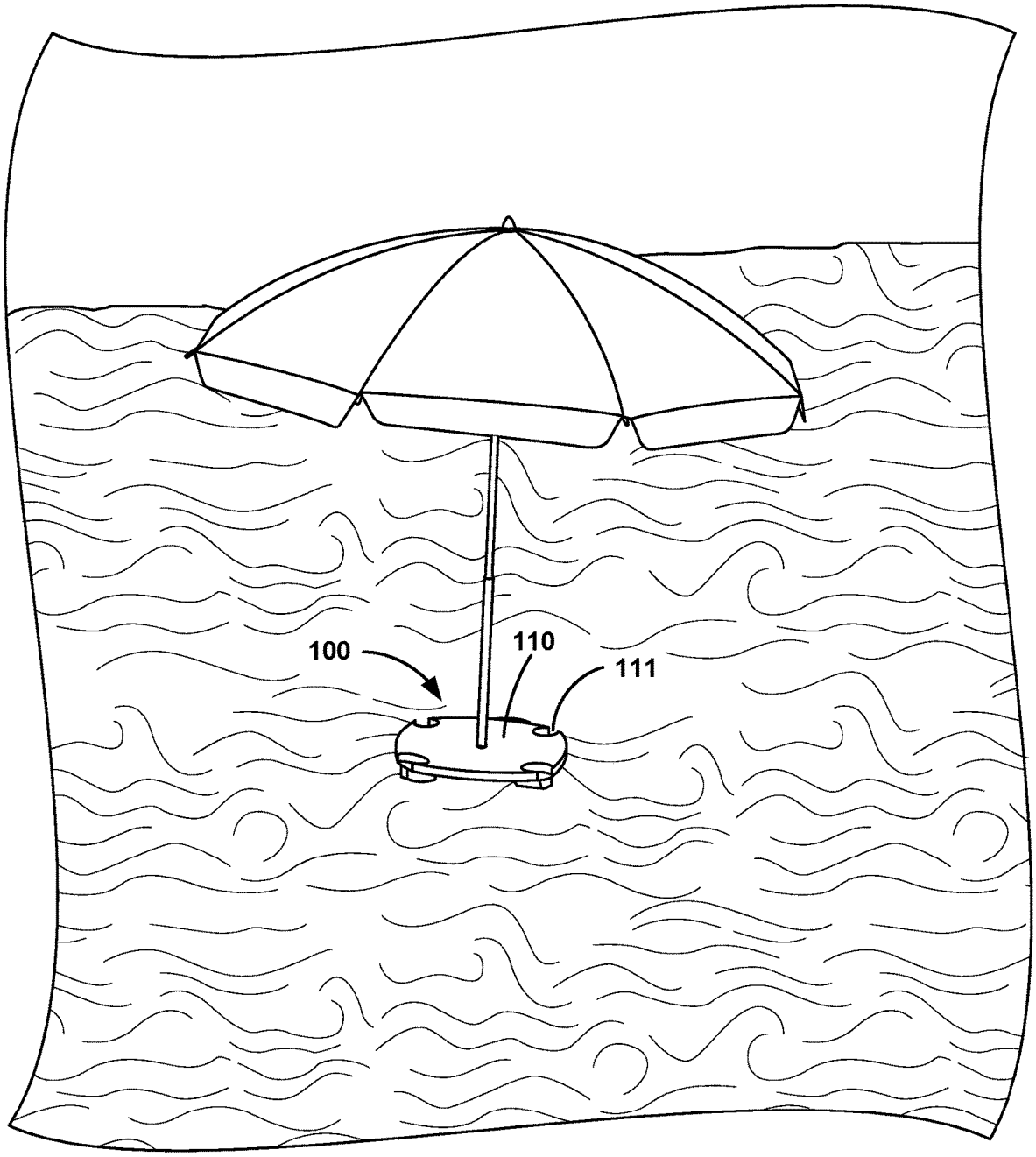
FIG. 2 illustrates a perspective view of an adjustable table in use in the water, according to an exemplary embodiment.

The table top 110 may take a variety of forms. For example, the table top 110 may be circular, square, rectangular, or oval, as non-limiting examples. Further, as shown in FIG. 2, the table top 110 may include one or more recessed holes 111 that may act as cup holders.

As shown in FIG. 1, in one example first elongated rod 104 and the second elongated rod 108 each include one or more through holes. In particular, the first elongated rod 104 includes one or more first through holes 112 and the second elongated rod 108 includes one or more second through holes 114. A coupling mechanism 116 may be used to adjust the height of the table top 110 by aligning one of the one or more first through holes 112 from the first elongated rod 104 with one of the one or more second through holes 114 from the second elongated rod 108, and positioning the coupling mechanism 116 therethrough. In one example, the coupling mechanism 116 comprises a cotter pin. In another example, the coupling mechanism 116 comprises a cylindrical rod made of metal, plastic, rubber, or some other material. Other coupling mechanisms are possible as well. The ability to adjust the height of the table top 110 with respect to the base 102 enables a user to position the adjustable table 100 in water having a variety of depths.

In one example, the table top 110 includes a plurality of through holes 120 to allow water to easily drain from the surface of the table top 110. Further, as shown in FIG. 1, in one example the table top 110 includes a through hole 122 positioned in a center of the table top 110 configured to receive a shaft 124 of an umbrella 126.

In one example, the second elongated rod 108 may include a stopper 128 configured to abut a bottom surface of the shaft 124 of the umbrella 126 to prevent the shaft 124 of the umbrella 126 from going too far towards the base 102. In one example, the stopper 128 is fixed to an interior surface of the second elongated rod 108. In one such example, the stopper 128 comprises a ring fixed to the interior surface of the second elongated rod 108, where the diameter of the hole in the ring is less than the diameter of the shaft 124 of the umbrella. In another example, stopper 128 comprises a disc fixed to the interior surface of the second elongated rod 108. Such a disc may prevent water from entering the second elongated rod 108 past the stopper 128.

In another example, the stopper 128 is adjustable to thereby adjust a distance between the table top 110 and the umbrella 126. In one example, the stopper 128 is configured to be positioned through one of the one or more second through holes 114 of the second elongated rod 108. In such an example, the stopper 128 may comprises a cotter pin, or a cylindrical rod made of metal, plastic, rubber, or some other material. In another example, in place of the stopper 128, the coupling mechanism 116 is configured to abut the bottom surface of the shaft 124 of the umbrella 126 to prevent the shaft 124 of the umbrella 126 from going too far towards the base 102.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

Because many modifications, variations, and changes in detail can be made to the described example, it is intended that all matters in the preceding description and shown in the accompanying figures be interpreted as illustrative and not in a limiting sense. Further, it is intended to be understood that the following clauses (and any combination of the clauses) further describe aspects of the present description.

What is claimed is:

1. An adjustable table comprising:

a base;

a first elongated rod coupled to the base, wherein the first elongated rod includes one or more first through holes;

a second elongated rod configured to translate with respect to the first elongated rod, wherein the second elongated rod includes one or more second through holes;

a table top coupled to the second elongated rod; and a coupling mechanism configured to be positioned between one of the one or more first through holes and one of the one or more second through holes to thereby set a distance between the table top and the base, wherein the table top includes a though hole positioned in a center of the table top configured to receive a shaft of an umbrella, and wherein the second elongated rod includes a stopper configured to abut a bottom surface of the shaft of the umbrella to thereby set a distance between the bottom surface of the shaft of the umbrella and the base.

2. The adjustable table of claim 1, wherein the base is capable of being filled with a material to increase a weight of the base.

3. The adjustable table of claim 2, wherein the base comprises a non-rigid material such that the base has a first shape when no material is positioned therein and the base has a second shape when material is positioned therein.

4. The adjustable table of claim 1, wherein the coupling mechanism comprises a cotter pin.

5. The adjustable table of claim 1, wherein the table top includes a plurality of through holes.

6. The adjustable table of claim 1, wherein the first elongated rod has a first inner diameter, wherein the second elongated rod has a second outer diameter that is less than the first inner diameter such that the second elongated rod is configured to slide within the first elongated rod.

7. The adjustable table of claim 1, wherein the first elongated rod has a first inner diameter, wherein the second elongated rod has a second outer diameter that is greater than the first inner diameter such that the first elongated rod is configured to slide within the second elongated rod.

* * * * *